US010838365B2

(12) United States Patent
Podvin et al.

(10) Patent No.: US 10,838,365 B2
(45) **Date of Patent: *Nov. 17, 2020**

(54) WATCH SAFETY VALVE

(71) Applicant: Omega SA, Biel/Bienne (CH)

(72) Inventors: Pierre Podvin, Morges (CH); Jean Baebler, Guemligen (CH)

(73) Assignee: Omega SA, Biel/Bienne (CH)

( * ) Notice: Subject to any disclaimer, the term of this patent is extended or adjusted under 35 U.S.C. 154(b) by 176 days.

This patent is subject to a terminal disclaimer.

(21) Appl. No.: 16/150,500

(22) Filed: Oct. 3, 2018

(65) Prior Publication Data

US 2019/0137937 A1 May 9, 2019

(30) Foreign Application Priority Data

Nov. 8, 2017 (EP) ..... 17200623

(51) Int. Cl.
*G04B 37/10* (2006.01)

(52) U.S. Cl.
CPC ..... *G04B 37/106* (2013.01); *G04B 37/103* (2013.01)

(58) Field of Classification Search
CPC ..... G04B 37/088; G04B 37/02; G04B 37/10; G04B 37/103; G04B 37/106; F16K 17/02
USPC ..... 368/291, 289–290, 288, 308, 319–321
See application file for complete search history.

(56) References Cited

U.S. PATENT DOCUMENTS 4,292,682 A * 9/1981 Wenger ..... G04B 37/106 368/289
5,257,247 A 10/1993 Miche et al.
6,137,750 A * 10/2000 Rieben ..... G04B 37/103 368/290
6,200,020 B1 3/2001 Rieben
9,123,483 B2 * 9/2015 Ferri ..... H01H 13/06
10,152,024 B2 * 12/2018 Baebler ..... G04B 37/103
2019/0137936 A1 * 5/2019 Podvin ..... F16K 17/04

FOREIGN PATENT DOCUMENTS

EP 0 554 797 A1 8/1993
EP 0 884 660 A1 12/1998
EP 2 166 420 A2 3/2010

OTHER PUBLICATIONS

European Search Report dated May 8, 2018 in European Application 17200623.1, filed on Nov. 8, 2017 (with English Translation of Categories of cited documents).

* cited by examiner

*Primary Examiner* — Edwin A. Leon
(74) *Attorney, Agent, or Firm* — Oblon, McClelland, Maier & Neustadt, L.L.P.

(57) ABSTRACT

A safety valve for a timepiece, particularly for a diving watch, including a discharge channel arranged to be able to be in fluid communication with the inside of a case of the timepiece when the valve is in an open configuration, in order to discharge excess fluid, particularly a gaseous fluid, the valve having a tube and a valve head provided with a cover and an axial skirt placed in various axial positions relative to the tube, and a pressure control module arranged inside a fluid duct provided in the tube and sliding axial guiding elements participating in controlling the movement of the valve head relative to the tube in the various axial positions, the safety valve including blocking elements preventing disconnection between the valve head and the tube and included in an outer or inner wall of the tube and in the valve head.

17 Claims, 7 Drawing Sheets

WATCH SAFETY VALVE

This application claims priority from European Patent Application No. 17200623.1 filed on Nov. 8, 2017, the entire disclosure of which is hereby incorporated herein by reference.

TECHNICAL FIELD

The present invention relates to a safety valve for a timepiece, particularly a wristwatch, and more specifically for a wristwatch intended for underwater diving. The present invention also relates to the timepiece provided with said valve.

TECHNOLOGICAL BACKGROUND

Helium valves are present in some diving watches in order to discharge helium that has penetrated the watch case during dives, called saturation dives, where the divers breathe a gaseous mixture containing helium and oxygen. This allows them to remain inside an underwater bell or station for several days. During this time period, the helium can penetrate the watch. Without such a valve, the internal excess pressure generated by the helium ingress can, during the decompression phase, cause damage to the watch, such as, for example, the loss of the glass, which disengages or cracks.

In the prior art, manual helium valves are known that operate simply by tightening/loosening a sealing element such as a valve head, like a crown screwed onto a tube driven or screwed onto the middle. Such valves conventionally comprise a piston connected to the valve head that is capable of exerting a pressure on a sealing gasket by cooperating with a spring so as to control the pressure inside the watch case.

However, one of the major disadvantages of such manual valves lies in a possible alteration of the seal of the watch case when these valves are in an open configuration, in which the valve head is loosened. Indeed, in such a configuration, as soon as a radial or substantially radial force, which may result from an impact, is applied to the valve head, its effect is to then generate an offset of the piston, causing a reduction in the pressure exerted by the piston on the sealing gasket and thus a loss of the seal of the watch case.

SUMMARY OF THE INVENTION

An aim of the present invention is to overcome the disadvantages of the prior art by proposing a valve in which the piston is separate from the valve head, whilst providing means that allow the valve head to be connected to the tube, with such a valve head being able to be easily handled during tightening/loosening operations.

To this end, the present invention relates to a safety valve for a timepiece, particularly for a diving watch, comprising a discharge channel arranged to be able to be in fluid communication with the inside of a case of said timepiece when said valve is in an open configuration, in order to discharge excess fluid, particularly a gaseous fluid, said valve comprising:

- a tube intended to be fastened in the case of the timepiece;
- a valve head provided with a cover and an axial skirt that is capable of being placed in various axial positions relative to said tube;

- a pressure control module separate from the valve head arranged inside a fluid duct provided in the tube;
- sliding axial guiding elements defined in the valve head and the tube participating in controlling the movement of the valve head relative to the tube in the various axial positions, said safety valve comprising blocking elements preventing disconnection between the valve head and said tube, said blocking elements being included in an inner or outer wall of the tube and in the valve head.

By virtue of these features, the effect associated with the application of a radial or substantially radial force on the valve head is particularly eliminated, and thus the risks of losing the valve seal and thus the watch case seal are eliminated.

In other embodiments:

- the blocking elements comprise a stop included in the inner wall of the fluid duct of said tube and a member for controlling the travel of the valve head provided to cooperate with said stop when the valve head is moved relative to the tube, particularly to prevent disconnection between the valve head and said tube;
- the member for controlling the travel of the valve head is an element added to the body of the valve head by being mechanically connected to an inner wall of a central connection element of the valve head;
- the stop is integrally formed with the inner wall of the fluid duct of said tube;
- the blocking elements are included in the outer wall of the tube and in the axial skirt of the valve head;
- the blocking elements comprise at least one elastic fastening element and at least one first corresponding hooking zone capable of cooperating together so as to prevent disconnection of the valve head from the tube;
- said at least one elastic fastening element is included in a chamber of complementary shape defined in the axial skirt when said first hooking zone is included in the outer wall of the tube;
- said at least one elastic fastening element is included in a chamber of complementary shape defined in the outer wall of the tube when said first hooking zone is included in the axial skirt;
- the axial guiding elements comprise first and second guiding zones, respectively fully or partly defined in an outer wall of a central connection element included in the cover of the valve head and in the inner wall of the fluid duct of the tube, particularly in an upper compartment of this duct;
- the first and second guiding zones are capable of cooperating together by sliding for an open or closed configuration of said valve;
- the fluid duct comprises an element for locking the valve head on the tube when the safety valve is in an open or closed configuration;
- the valve comprises an elastic return element arranged between a shoulder included in the inner wall of the tube and the member for controlling the travel of the valve head;
- the pressure control module comprises a piston and an elastic member, said piston being housed inside the fluid duct of the tube and the elastic member being arranged in said fluid duct so as to cooperate with the piston, said piston being configured to axially move in response to pressure variations inside the case;
- the pressure control module comprises a sealing element located in the fluid duct between first and second fastening elements, said sealing element comprising a membrane arranged to be permeable to gases and to establish fluid communication from the inside of the case to the outside when said internal pressure exceeds a predetermined value and to be impermeable to liquids circulating from the outside of the case to the inside of the case; and the valve comprises a visual indicator of an axial position of the valve head relative to the tube, particularly of a first or a second axial position of this valve head.

The invention also proposes a timepiece comprising such a safety valve.

BRIEF DESCRIPTION OF THE FIGURES

Further features and advantages of the present invention will become apparent upon reading the embodiments of the invention, which are provided solely by way of a non-limiting example and are described with reference to the accompanying drawings, in which.

DETAILED DESCRIPTION OF THE INVENTION

Figure 8:
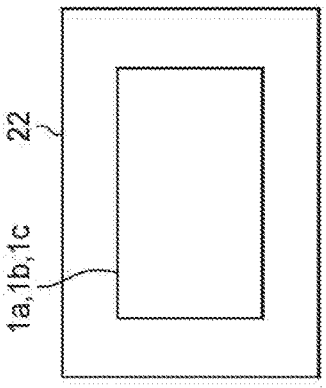
FIG. 8 shows the timepiece comprising such a safety valve.

The present invention relates to a valve allowing excess fluid F, preferably gaseous fluid such as helium present in a case of a timepiece 22 shown in FIG. 8, to be discharged. Such a valve is also called a helium valve or even a safety valve for a timepiece 22, and particularly for a diving watch. This valve is denoted using the general reference numerals 1*a*, 1*b*, 1*c* in the drawings.

In the three embodiments of the safety valve 1*a* to 1*c* shown in FIGS. 1 to 7, this valve 1*a* to 1*c* comprises a tube 3*a*, 3*b*, 3*c* intended to be fastened on the watch case by screwing or driving in the middle 20 of this case. When this tube 3*a* to 3*c* is screwed onto the middle, it comprises a threaded zone 21 defined in a lower portion included in this middle 20. This tube 3*a* to 3*c* has, in its middle section, a bulge provided with a groove, in which an O-ring 23 is housed, providing its seal in the vicinity of the middle 20. In the example shown, the tube 3*a* to 3*c* is terminated by an upper emerging portion of the middle 20, designed to be covered by a valve head 2*a*, 2*b*, 2*c*. Of course, according to a variation, the tube 3*a* to 3*c* can be embedded in the middle 20.

In the first and second embodiments of the safety valve 1*a*, 1*b*, shown in FIGS. 1 to 4 and 7, the tube 3*a*, 3*b* comprises a fluid duct 10. This fluid duct 10 is provided with an inner step 24 delimiting an upper compartment 13*a* from a lower compartment 13*b* of this duct 10, the lower compartment 13*b* comprising a channel connected to the inside of the case. It is to be noted that this step 24 is integrally formed with an inner wall 18*b* of the tube 3*a*, 3*b*. In a variation, such a step 24 can be an added part.

In the various embodiments of the valve 1*a* to 1*c*, the valve head 2*a* to 2*c* has a body of generally cylindrical shape. This valve head 2*a* to 2*c* comprises a cover 4 and an axial skirt 5 having rotational symmetry about an axis of rotation A of this valve head 2*a* to 2*c*. This cover 4 and the axial skirt 5 define a cavity 25 in the valve head 2*a* to 2*c*.

In this valve head 2*a* to 2*c*, the cover 4 comprises a central connection element 16 projecting from an internal face of this cover 4 by axially extending in this cavity 25 in a direction of the axis A. In this configuration, such a central connection element 16 therefore is rigidly connected to the cover 4 and preferably has a circular transverse section perpendicular to the axis A. In FIGS. 1, 2, 5 and 6, which relate to the first and third embodiments of the valve 1*a*, 1*c*, this central connection element 16 can form a central barrel by being in the form of a hollow cylinder designed to assemble, in the valve head 2*a*, 2*c*, a member 17*b* for controlling the travel of this valve head 2*a*, 2*c*. Such a control member 17*b* is an element that is added to the body of this valve head 2*a*, 2*c*. This control member 17*b* is mechanically connected to an inner wall 19*a* of the central connection element 16, in the vicinity of one of the ends thereof, by screwing, for example. It is to be noted that in FIGS. 3, 4 and 7, which relate to the second embodiment, the central connection element 16 has an end of tapered shape so as to facilitate its insertion in the upper compartment 13*a* of the tube 2*b*.

Figure 3:
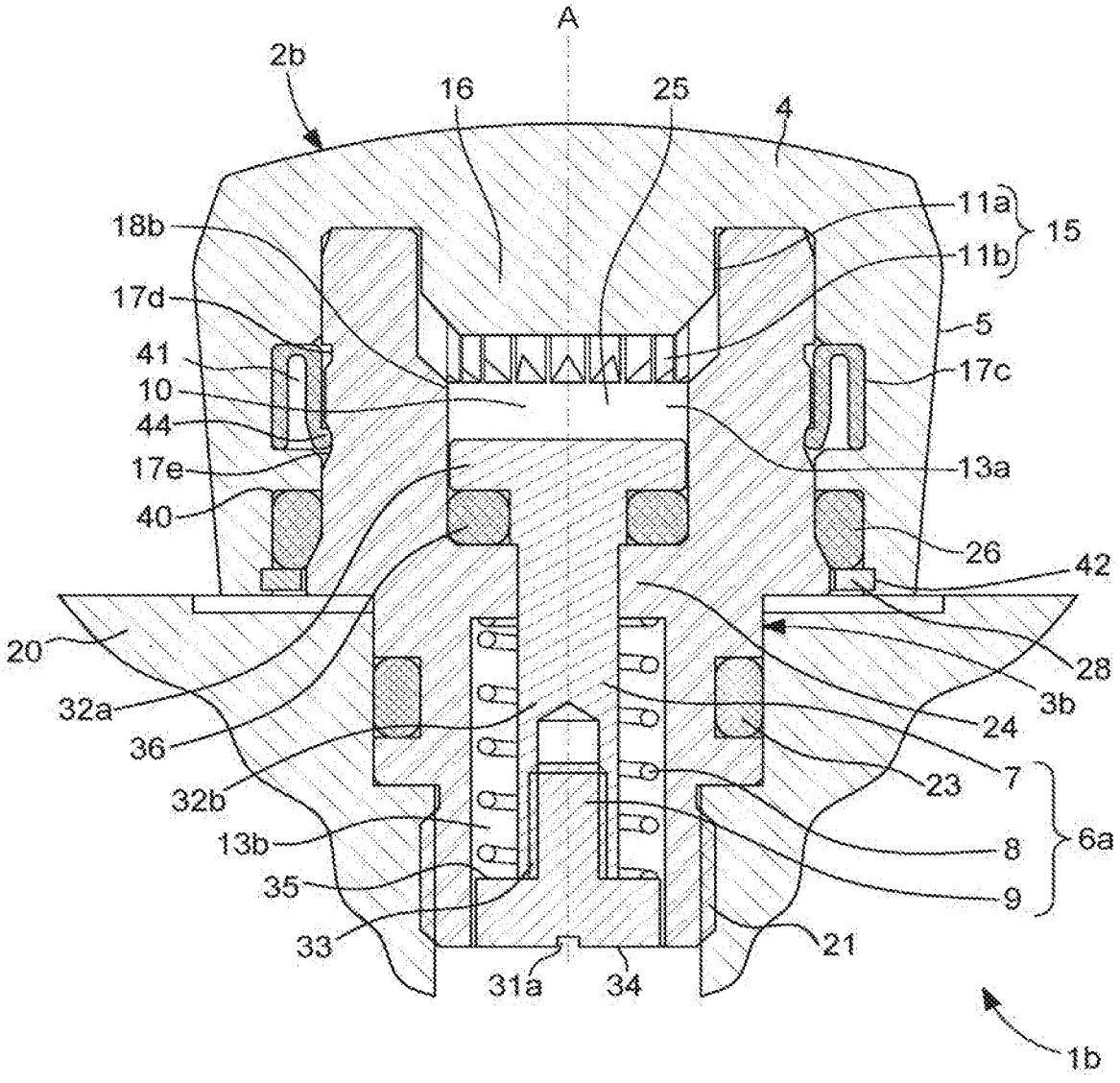
FIG. 3 is a section view of a safety valve capable of being mounted on a middle of the watch case in a closed configuration, comprising a pressure control module provided with a piston, according to a second embodiment of the invention.
Figure 4:
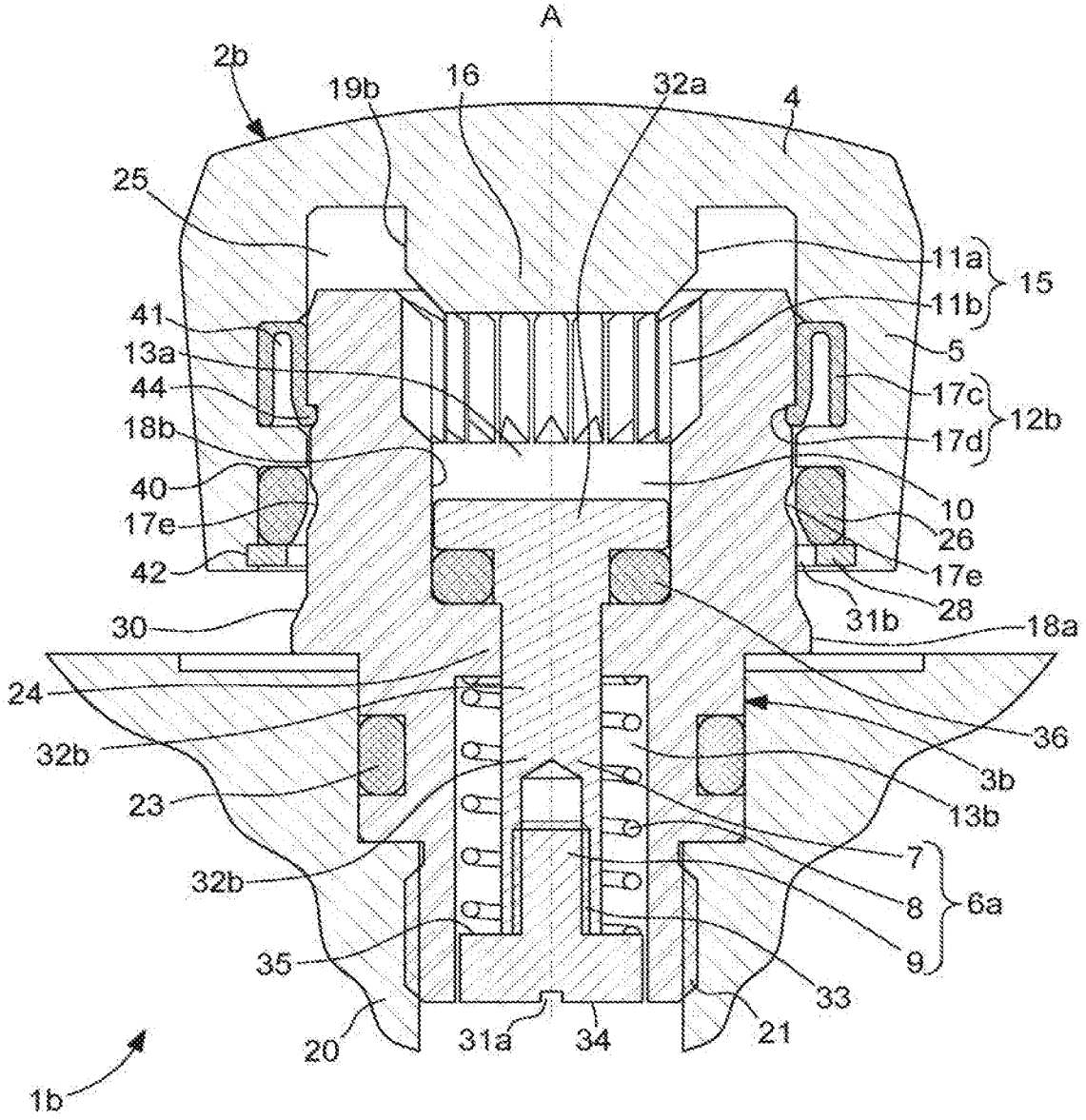
FIG. 4 shows a view similar to FIG. 3, in which the safety valve is in an open configuration, according to the second embodiment of the invention.

The safety valve 1*a* to 1*c* also comprises a sealing gasket 26 interposed between the axial skirt 5 of the valve head 2*a* to 2*c* and the tube 3*a* to 3*c*, so as to provide the seal for this safety valve 1*a* to 1*c*. In this context, this sealing gasket 26 is an O-ring. In FIGS. 1, 2, 5 and 6, which relate to the first and third embodiments of this safety valve 1*a*, 1*c*, this sealing gasket 26 is axially held between a spacer 29 positioned against an inner wall of the axial skirt 5 of the valve head 2*a*, 2*c* and a retention ring 28. This annular shaped retention ring 28 is fastened, for example, by driving, in a groove 42 of corresponding shape that is located towards the base of the axial skirt 5 facing the outer wall 18*a* of the tube 3*a*, 3*c*. According to a variation, the spacer 29 and/or the retention ring 28 can be integrally formed with the axial skirt 5. In FIGS. 3, 4 and 7, which relate to the second embodiment of the safety valve 2*b*, such a sealing gasket 26 is arranged between a circular shoulder 40 produced in the axial skirt 5 and an annular shaped retention ring 28.

Figure 1:
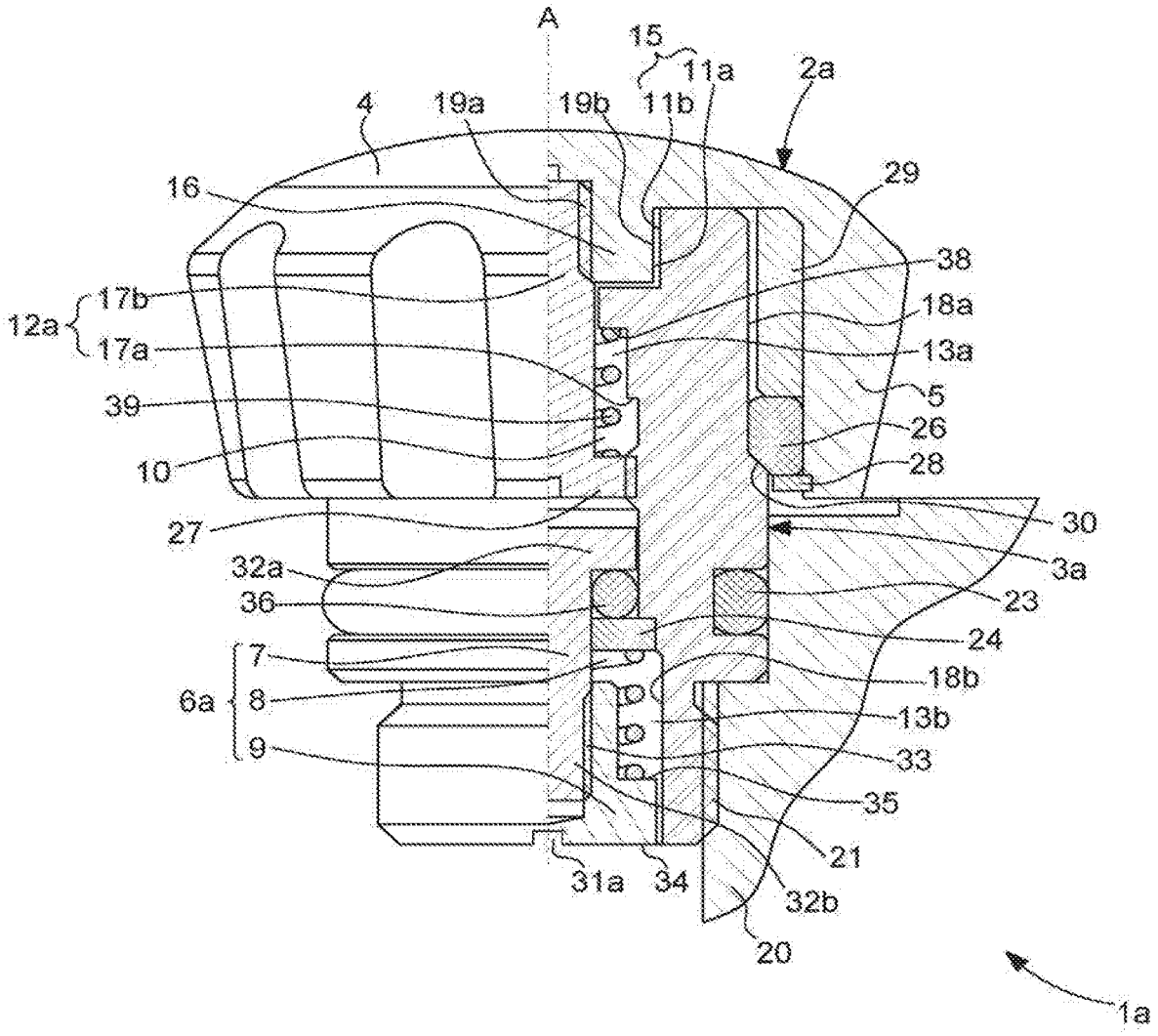
FIG. 1 is a half-section view of a safety valve capable of being mounted on a middle of a watch case in a closed configuration, comprising a pressure control module provided with a piston, according to a first embodiment of the invention.
Figure 2:
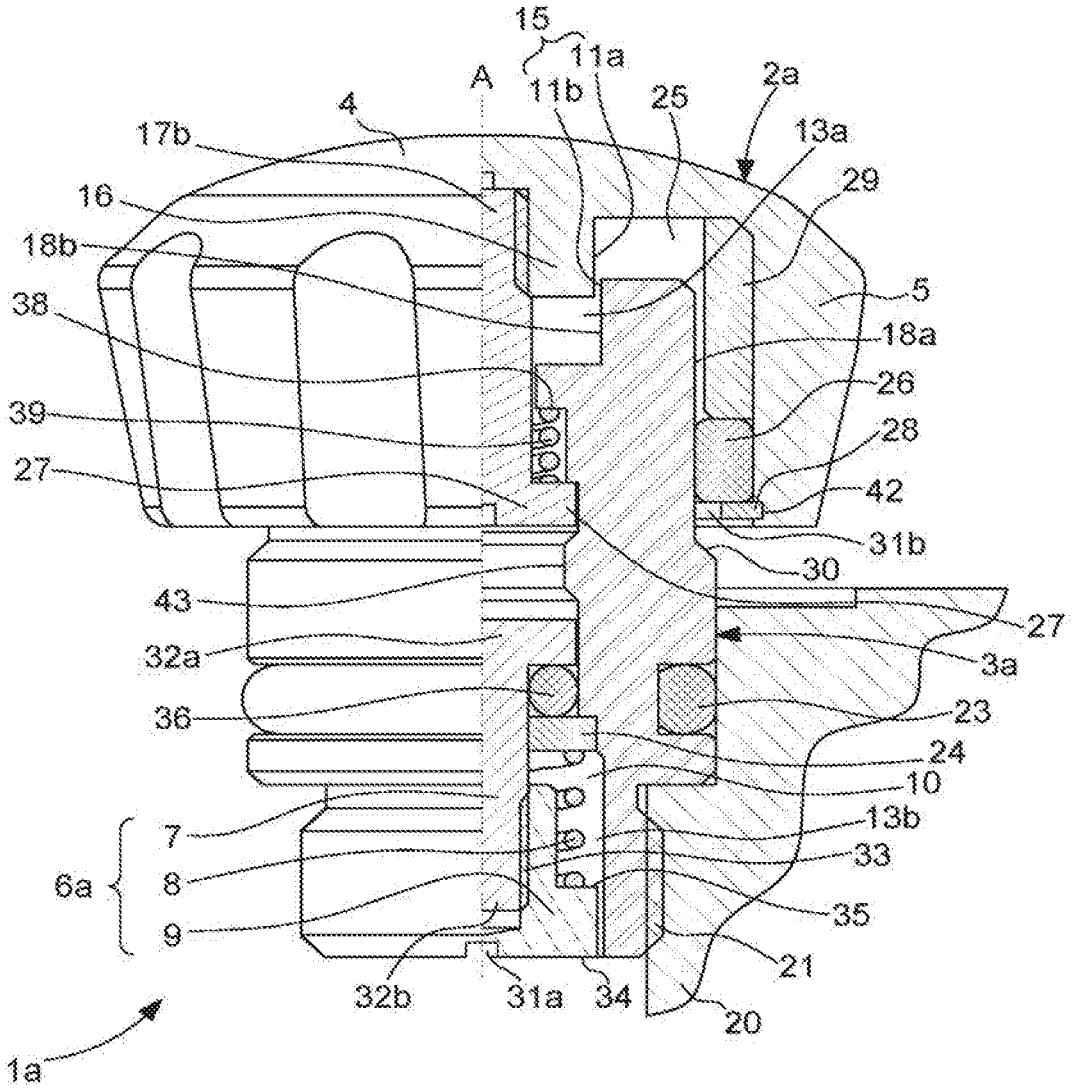
FIG. 2 shows a view similar to FIG. 1, in which the safety valve is in an open configuration, according to the first embodiment of the invention.
Figure 5:
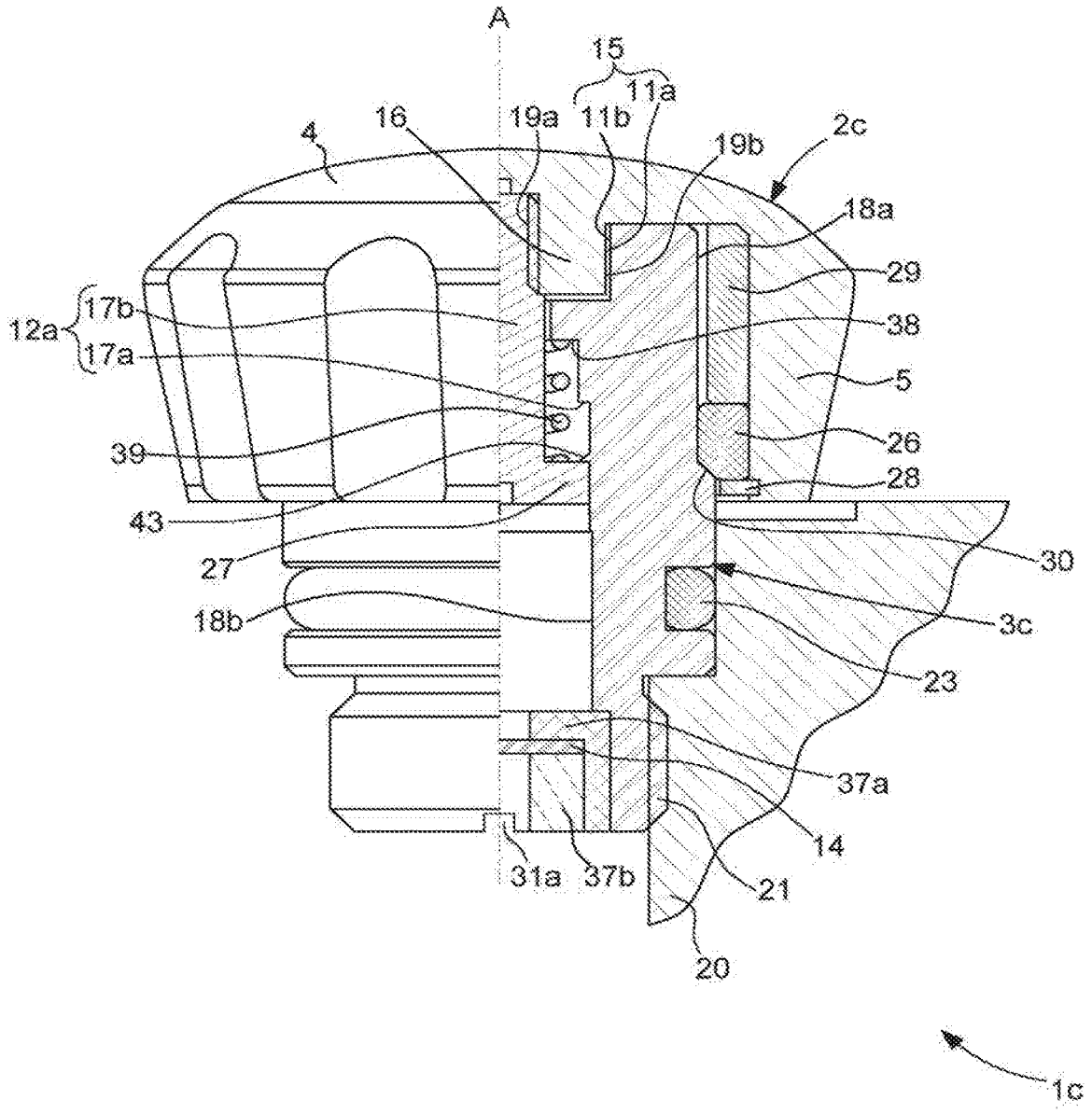
FIG. 5 is a half-section view of a safety valve capable of being mounted on a middle of a watch case in a closed configuration, comprising a pressure control module provided with a sealing element comprising a membrane, according to a third embodiment of the invention.

In these various embodiments, when the safety valve 1*a* to 1*c* is in a closed configuration, as shown in FIGS. 1, 3 and 5, the sealing gasket 26 is over-compressed by a bulge 30 of the tube 3*a* to 3*c*, so that the sealing properties are as good as possible.

In this valve 1*a* to 1*c*, the valve head 2*a* to 2*c* can be configured in first and second axial positions. More specifically, in the first axial position shown in FIGS. 1, 3 and 5, the valve 1*a* to 1*c* is then in a closed configuration, with a valve head 2*a* to 2*c* hermetically closing the fluid duct 10 of the tube 3*a* to 3*c*, so as to thus prevent any fluid F circulation in the safety valve 1*a* to 1*c*. In the second axial position shown in FIGS. 2, 4 and 6, the valve 1*a* to 1*c* is in an open configuration with the valve head 2*a* to 2*c*, which no longer obstructs this fluid duct 10.

The safety valve 1*a* to 1*c* also comprises axial guiding elements 15 allowing the axial movement of the valve head 2*a* to 2*c* to be controlled relative to the tube 3*a* to 3*c*, so as to configure this head 2*a* to 2*c* in either of its axial positions. These guiding elements 15 comprise first and second guiding zones 11*a*, 11 *b*, respectively fully or partly defined in an outer wall 19*b* of the central connection element 16 included in the cover 4 of the valve head 2*a* to 2*c* and in the inner wall 18*b* of the fluid duct 10 of the tube 3*a* to 3*c*. In the first and second embodiments, this second guiding zone 11*b* is included in the inner wall 18*b* of the upper compartment 13*a* of the fluid duct 10. These first and second guiding zones 11*a*, 11 *b* are capable of cooperating together by sliding during movements of the valve head 2*a* to 2*c* between the various axial positions. In this context, the safety valve 1*a* to 1*c* can be transitioned from the closed configuration to the open configuration by pulling the valve head 2*a* to 2*c*, with an operation for pushing this valve head 2*a*, 2*c* having to be carried out for the transition from the open configuration to the closed configuration.

This safety valve 1*a* to 1 *c* also comprises blocking elements 12*a*, 12*b* preventing disconnection between the valve head 2*a* to 2*c* and the tube 3*a* to 3*c*, particularly when the valve head 2*a* to 2*c* is in the second axial position. In this valve 1*a* to 1*c*, the blocking elements 12*a*, 12*b* are included in an outer or inner wall 18*a*, 18*b* of the tube 3*a* to 3*c*, as well as in the valve head 2*a* to 2*c*.

More specifically, in the first and third embodiments, the blocking elements 12*a* comprise a stop 17*a*, also called "valve head travel limitation stop". This stop 17*a* is included in the inner wall 18*b* of the fluid duct 10 of the tube 3*a*, 3*c*. These blocking elements 12*a* also comprise the member 17*b* for controlling the travel of the valve head 2*a*, 2*c*, as previously described and which is provided to cooperate with the stop 17*a* when the valve head 2*a*, 2*c* is moved relative to the tube 3*a*, 3*c* in order to be in the second axial position, so as to configure the valve 1*a*, 1*c* in its open configuration. It is to be noted that in the first and third embodiments, this stop 17*a* is integrally formed with the inner wall 18*b* of the fluid duct 10 of the tube 3*a*, 3*c*.

In the second embodiment of this safety valve 2*b* shown in FIGS. 3, 4 and 7, the blocking elements 12*b* comprise at least one elastic fastening element 17*c* of the clipping element type and at least one first hooking zone 17*d* compatible with the elastic fastening element 17*c*. The first hooking zone 17*d* is also called "connection hooking zone", since it participates in keeping the valve head 2*b* rigidly connected to the tube 3*b* when the safety valve 1*b* is in its open configuration. The elastic fastening element 17*c* is included in a chamber 41 of complementary shape that is provided in the axial skirt 5 and the first hooking zone 17*d* is defined in the outer wall 18*a* of the tube 3*b*. This first hooking zone 17*d* can form a groove provided in this outer wall 18*a* of the tube 3*b*. The fastening element 17*c* preferably is "U"-shaped by being formed by two branches, a connection branch and a branch for positioning in said chamber 41. When the elastic fastening element 17*c* is located in the chamber 41, the positioning branch is then arranged in contact with a bottom of this chamber 41, so that a free end 44 of the connection branch projects from this chamber 41. The shape of this free end 44 of the connection branch complements that of the hooking zone 17*d*. In a variation of this second embodiment, the elastic fastening element 17*c* can be included in a complementary shaped chamber provided in the outer wall 18*a* of the tube 3*b* and the first hooking zone 17*d* in the axial skirt 5.

It is to be noted that, in this second embodiment, the outer wall 18*a* of the tube 3*b* can comprise at least one second hooking zone 17*e*, called "locking hooking zone", which is provided to cooperate with said at least one elastic fastening element 17*c*, so as to keep the safety valve 1*b* in its closed configuration and thus keep the valve head 2*b* in its first position. Thus, in this second embodiment, the valve 1*b* can be configured in either of the open and closed configurations as a function of a manipulation of the valve head 2*b* that allows it to be configured in a first or second axial position by a manipulation of this valve head 2*b* intended to pull or push said valve head. In this context, the free end 44 of the elastic fastening element 17*c* can be arranged in the first hooking zone 17*d* or the second hooking zone 17*e*.

In the first and third embodiments of the safety valve 1*a*, 1*c* shown in FIGS. 1, 2, 5 and 6, the fluid duct 10 is also provided with an element 43 for locking the valve head 2*a*, 2*c* on the tube 3*a*, 3*c* when the safety valve 1*a*, 1*c* is in an open or closed configuration. This locking element 43 comprises a protuberance projecting in the inner wall 18*b* of the fluid duct 10. Such a locking element 43 is capable of cooperating with a free end 27 of the member 17*b* for controlling the travel of the valve head 2*a*, 2*c* when the safety valve 1*a*, 1*c* is in a closed configuration, so as to keep the valve head 2*a*, 2*c* in a state that is locked on the tube 3*a*, 3*c*. In a variation, this locking element 43 can also cooperate with this free end 27 of the member 17*b* for controlling travel, so as to keep the valve head 2*a*, 2*c* at a distance from the tube 3*a*, 3*c* and in a locked state when the safety valve 1*a*, 1*c* is in an open configuration. In these two embodiments, the shape of this free end 27 of the member 17*b* for controlling the travel complements that of this locking element 43, so as to retain the valve head 2*a*, 2*c* in these locked states on the tube 3*a*, 3*c* in the closed and/or open configuration of the valve 1*a*, 1*c*.

Such a locked state of the valve head 2*a*, 2*c* on the tube 3*a*, 3*c* in the first and second axial positions helps to ensure that the valve 1*a*, 1*c* is maintained in a blocked open or closed configuration. In this context, the transition from this locked state to an unlocked state, prior to a transition from one configuration of the valve 1*a*, 1*c* to another, then requires the application of a force to the valve head 2*a*, 2*c* that must be greater than the friction force present between the locking element 43 and the free end 27 of the member 17*b* for controlling the travel.

In these first and third embodiments, the safety valve 1*a*, 1*c* also comprises an elastic return element 39, for example, a helical spring, arranged between a shoulder 38 included in the inner wall 18*b* of the duct 10 of the tube 3*a*, 3*c* and the free end 27 of the member 17*b* for controlling the travel of the valve head 2*a*, 2*c*. This shoulder 38 and the free end 27 of the member 17*b* for controlling the travel of the valve head 2*a*, 2*c* are capable of applying a restriction force to said elastic return element 39 so that it can be compressed when the valve 1*a*, 1*c* transitions from a closed configuration to an open configuration. In this context, the elastic return force resulting from this compression of the elastic return element 39 is designed to participate in the transition of the valve head 2*a*, 2*c* from the second axial position to the first axial position, where the valve 1*a*, 1 *c* is in a closed configuration, and this occurs when an additional force is applied to this valve head 2*a*, 2*c*. Such an elastic return force allows an additional low intensity force to be applied that helps to facilitate the implementation of the transition from the open configuration to the closed configuration of the valve 1*a*, 1*c*.

In these embodiments, such a safety valve 1*a* to 1*c* comprises a discharge channel arranged to be able to be in fluid communication with the inside of the case when the valve 1*a* to 1*c* is in its open configuration, so as to discharge the excess fluid F. This discharge channel comprises the fluid duct 10 defined in the tube 3*a* to 3*c* and a fluid passage included between the outer wall 18*a* of this tube 3*a* to 3*c* and an inner wall of the axial skirt 5 of the valve head 2*a* to 2*c*. This discharge channel comprises an inlet 31*a* included in the vicinity of an opening defined in the lower portion of the tube 3*a* to 3*c* and an outlet 31*b* included between the inner wall of the base of the axial skirt 5 and the outer wall 18*a* of the tube 3*a* to 3*c*.

Furthermore, in these embodiments, the safety valve 1*a* to 1*c* also comprises a pressure control module 6*a*, 6*b* that is separate from the valve head 2*a* to 2*c*. In particular, in the first and second embodiments, the pressure control module 6*a* of the safety valve 1*a*, 1*b*, 1*c* comprises a piston 7, an elastic member 8 and a piston activation member 9. In this pressure control module 6*a*, the piston 7 is housed in the fluid duct 10 defined in the tube 3*a*, 3*b*. This piston 7 is mounted to slide in this tube 3*a*, 3*b* and is of basically cylindrical shape and comprises two parts 32*a*, 32*b*. The first part 32*a* comprises a head of the piston that is arranged in the upper compartment 13*a* of the fluid duct 10 of the tube 3*a*, 3*b* and which is capable of cooperating with the inner wall 18*b* of this compartment 13*a*, so as to help guide the piston 7 when it moves in this duct 10. With respect to the second part 32*b*, it is positioned both in a central opening arranged in the inner step 24 and in the lower compartment 13*b* of the fluid duct 10. This second part 32*b* of the piston 7 comprises a free end designed to receive the activation member 9 of the piston 7.

Such an activation member 9 is intended to be in contact with the fluid F. It comprises a connection component 33 allowing it to be fastened to the free end of the second part 32*b* of the piston 7. This connection component 33 can be of cylindrical shape and can comprise a threaded part on its inner wall that is screwed into a tapped part of this free end of the second part 32*b* of the piston 7. This activation member 9 comprises a bearing face 34, on which the fluid F originating from the case is likely to exert a pressure force. This bearing face 34 is capable of partially and even fully obstructing the inlet 31*a* of the discharge channel.

In this pressure control module 6*a*, the elastic member 8, for example, a compression spring of the helical type, is capable of being passed through by the second part 32*b* of the piston 7 by being arranged in the lower compartment 13*b* of the fluid duct 10 of the tube 3*a*, 3*b*. In this lower compartment 13*b*, the spring comprises first and second ends that are respectively in abutment on the inner step 24 and on a support face 35 of the activation member 9 that can be parallel to the bearing face 34. In this lower compartment 13*b*, the spring is mounted so as to be axially compressed between the inner step 24 and the support face 35, so that the head 32*a* of the piston can clamp an O-ring 36 against the inner step 24, so as to provide the seal for the safety valve 1*a*, 1*b*.

Thus, in this configuration, when excess pressure is present inside the case, the fluid F, in this case gaseous helium, makes contact with the bearing face 34 of the activation member 9. When the pressure force exerted on the bearing face 34 is greater than or equal to a threshold pressure force for activating the safety valve 1*a*, 1 *b*, 1*c*, the activation member 9 causes the piston 7 to move against an elastic return force of the spring, then causing it to deform and the fluid F to transition from the lower compartment 13*b* to the upper compartment 13*a* via the central opening of the step 24, in order to discharge this fluid F through the outlet 31*b* of the discharge channel. This threshold pressure force, which generates the activation/release of the safety valve 1*a*, 1*b*, can be adapted to the operating circumstances of the valve 1*a*, 1*b*, with this adaptation being carried out by selecting a compression spring stiffness and/or by a configuration of the dimensions of the surface of the bearing face 34 of the activation member 9 of the piston 7.

In this configuration, it is to be noted that, in the first embodiment, the top of the first part 32*a* of the piston 7 forming the head of this piston can be of complementary shape (for example, a square) to that of part of a free end 27 (hollow) of the control member 17*b* arranged facing this top, so as to be temporarily rotationally rigidly connected in order to facilitate the assembly of this control member 17*b* and of the piston 7 in the safety valve 1*a* during the assembly of such a valve 1*a*.

Figure 6:
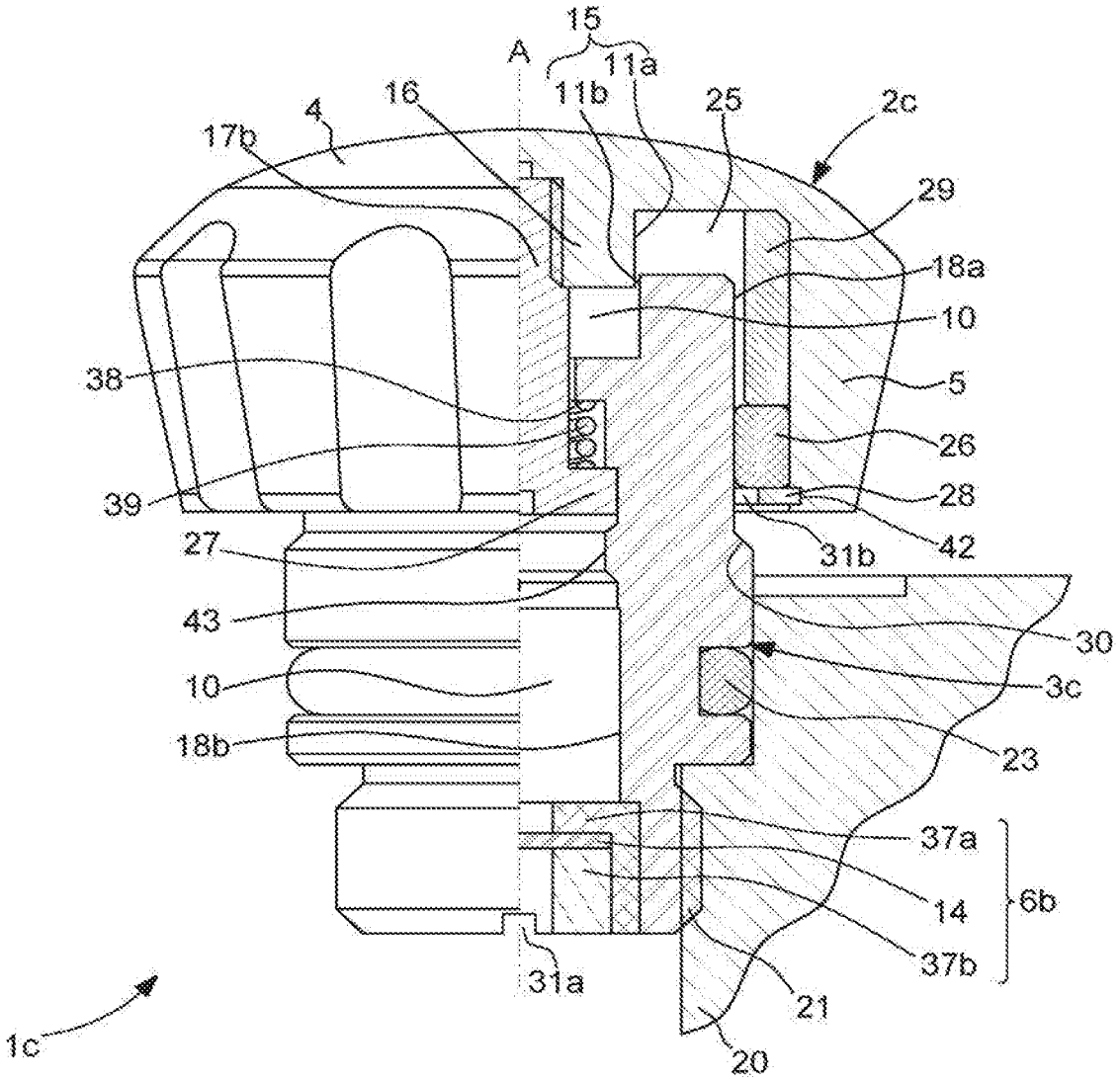
FIG. 6 shows a view similar to FIG. 5, in which the safety valve is in an open configuration, according to the third embodiment of the invention.
Figure 7:
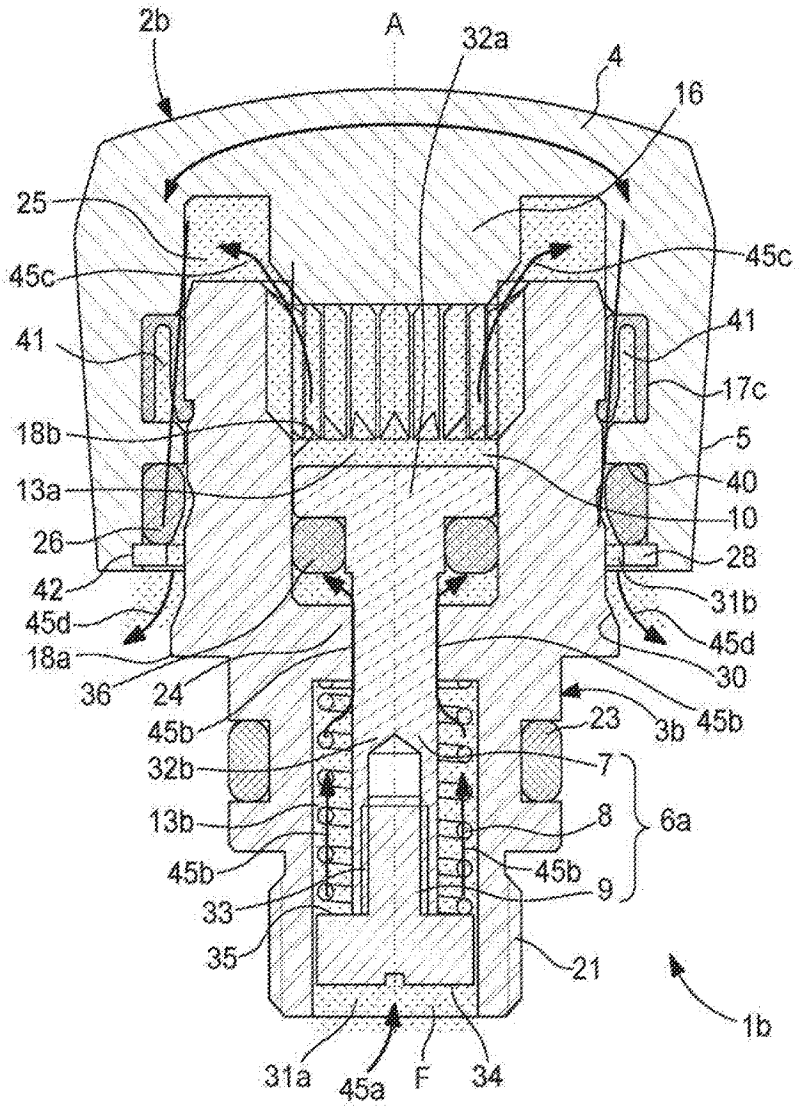
FIG. 7 shows a section view of the safety valve shown in FIG. 4, through which a fluid passes that is circulating in a discharge channel, according to the third embodiment of the invention.

In the third embodiment that can be seen in FIGS. 5 and 6, the pressure control module 6*b* comprises a sealing element 14 located in the fluid duct 10 in the vicinity or even inside the inlet 31*a* of the discharge channel. This sealing element 14 is arranged in this fluid duct 10 so as to obstruct said duct. This sealing element 14 comprises a membrane 14 that is interposed between first and second fastening elements 37*a*, 37*b* that connect it to the inner wall 18*b* of the fluid duct 10. In other words, this membrane 14 is clamped between these two fastening elements 37*a*, 37*b*. Such a membrane is arranged to be:

- permeable to gases and to establish fluid communication from the inside of the case to the outside when the pressure inside the case exceeds a predetermined value; and
- impermeable to liquids circulating from the outside of the case to the inside of the case.

Thus, in this configuration, when excess pressure is present inside the case, the fluid F, in this case gaseous helium, makes contact with the membrane 14, which is permeable to gases, which allows the fluid F to pass through said membrane and to circulate in the fluid duct 10, as well as the fluid passage of the discharge channel so as to be discharged outside the case. It is to be noted that, by virtue of the presence of this membrane, the liquids are stopped and the case seal is still provided. Furthermore, such a membrane is made up of a polymer film that is impermeable to water and permeable to gases. Typically, the polymer film is supported by a substrate that is porous to gases. Advantageously, this membrane can be a membrane marketed by Gore under reference "Acoustic vent GAW331".

Thus, in these various embodiments, the pressure control module 6*a*, 6*b* of this valve 1*a* to 1*c* allows the pressure variations to be controlled that are inside the watch case and that are a result of the diver returning to the surface, for example.

In addition, the valve 1*a* to 1*c* can comprise a visual indicator of an axial position of the valve head 2*a* to 2*c* relative to the tube 3*a* to 3*c*, particularly of a first or a second axial position of this valve head 2*a* to 2*c*. Such a visual indicator can be a ring that is arranged in a complementary shaped chamber defined in the outer wall 18*a* of the tube 3*b*. This visual indicator, which preferably is a different colour to that of the outer walls 18*a* of this tube 3*b* and of the valve head 2*b*, is positioned in this outer wall 18*a* so as to be covered/uncovered by the base of the axial skirt 5. Thus, such a visual indicator is capable of being hidden by the base of this axial skirt 5 when the valve head 2*b* is in the first axial position and revealed when the valve head 2*b* is in a different axial position from this first position, particularly when it is in the second axial position by being fully or partly uncovered by this base of the axial skirt 5.

With reference to FIGS. 2, 4, 6 and 7, when the safety valve 1*a* to 1*c* is transitioned from the closed configuration to the open configuration by applying a force in an axial direction on the valve head 2*a* to 2*c*, then, in the first axial position intended to pull or to axially move it relative to the tube 3*a* to 3*c*, the discharge channel of this valve 1*a* to 1*c* is then in fluid communication with the inside of the case. In this context, the valve head 2*a* to 2*c* is kept fixed, particularly radially, by virtue of the blocking elements 12*a*, 12*b* and/or the axial guiding elements 15. In this configuration, the excess fluid F is then discharged via the discharge channel. This discharging of this excess fluid F is described hereafter by way of an example for the embodiment of the valve 1*b* shown in FIGS. 3, 4 and 7. More specifically, in FIG. 7, during this discharging, this excess fluid F leaves the case in order to penetrate the valve 1*b* in the vicinity of the inlet 31*a* included in the opening defined in the lower portion of the tube 3*b* and this occurs in the direction of the arrow 45*a*. This fluid F then exerts a pressure force on the bearing face 34 of the activation member 9, which then leads to the compression of the elastic member 8 and thus the lift of the piston 7. In this configuration, the fluid F then circulates in the lower compartment 13*b* of this duct 10 in the direction of the arrows 45*b*, before penetrating the upper compartment 13*a* by passing through the central opening provided in the inner step 24. Subsequently, in the direction of the arrows 45*c* and 45*d*, this fluid F leaves the upper compartment 13*a* in order to pass through the fluid passage included between the outer wall 18*a* of this tube 3*b* and the inner wall of the axial skirt 5 of the valve head 2*b* up to the outlet 31*b* of this discharge channel included between the inner wall of the base of the axial skirt 5 and the outer wall 18*a* of the tube 3*b*.

Advantageously, the seal of such a safety valve 1*a* to 1*c* is improved due to the fact that the valve head 2*a* to 2*c* is separate from the pressure control module 6*a*, 6*b*, thus meaning that manipulating this valve head 2*a* to 2*c* does not affect the sealing element 14 or the axial positioning of the piston 7. Indeed, the valves of the prior art often undergo modifications to the axial positioning of the piston during manipulations of the valve head that cause fluid leaks, even though the pressure force of this fluid is below the threshold pressure force.

What is claimed is:

1. A safety valve for a timepiece, including a discharge channel in fluid communication with the inside of a case of said timepiece when said valve is in an open configuration, in order to discharge excess gaseous fluid, said valve comprising:

a tube fastenable to the case of the timepiece;

a valve head having a cover and an axial skirt placeable in various axial positions relative to said tube;

a pressure control mechanism separate from the valve head arranged inside a fluid duct provided in the tube; and sliding axial guiding elements defined in the valve head and the tube participating in controlling movement of the valve head relative to the tube in the various axial positions, wherein said safety valve includes blocking elements preventing disconnection between the valve head and said tube, and said blocking elements are included in an outer or inner wall of the tube and in the valve head.

2. The valve according to claim 1, wherein the blocking elements include a stop included in the inner wall of the fluid duct of said tube and a member controlling travel of the valve head provided to cooperate with said stop when the valve head is moved relative to the tube to prevent disconnection between the valve head and said tube.

3. The valve according to claim 2, wherein the member controlling the travel of the valve head is an element added to a body of the valve head by being mechanically connected to an inner wall of a central connection element of the valve head.

4. The valve according to claim 2, wherein the stop is integrally formed with the inner wall of the fluid duct of said tube.

5. The valve according to claim 1, wherein the blocking elements are included in the outer wall of the tube and in the axial skirt of the valve head.

6. The valve according to claim 1, wherein the blocking elements include at least one elastic fastening element and at least one first corresponding hooking zone are cooperatable together to prevent disconnection of the valve head from the tube.

7. The valve according to the claim 6, wherein said at least one elastic fastening element is included in:

a chamber of complementary shape defined in the axial skirt when said first hooking zone is included in the outer wall of the tube, or a chamber of complementary shape defined in the outer wall of the tube when said first hooking zone is included in the axial skirt.

8. The valve according to claim 1, wherein the axial guiding elements include first and second guiding zones, respectively fully or partly defined in an outer wall of a central connection element included in the cover of the valve head and in the inner wall of the fluid duct of the tube.

9. The valve according to claim 8, wherein the first and second guiding zones are cooperatable together by sliding to an open or closed configuration of said valve.

10. The valve according to claim 1, wherein the fluid duct includes an elements locking the valve head on the tube when the safety valve is in an open or closed configuration.

11. The valve according to claim 3, further comprising an elastic return element arranged between a shoulder included in the inner wall of the tube and the member for controlling the travel of the valve head.

12. The valve according to claim 1, wherein the pressure control mechanism includes a piston and an elastic member, said piston being housed inside the fluid duct of the tube and the elastic member being arranged in said fluid duct to cooperate with the piston, said piston being configured to axially move in response to pressure variations inside the case.

13. The valve according to claim 1, wherein the pressure control mechanism includes a sealing element located in the fluid duct between first and second fastening elements, said sealing element includes a membrane permeable to gases and establishing fluid communication from the inside of the case to the outside when an internal pressure exceeds a predetermined value and impermeable to liquids circulating from the outside of the case to the inside of the case.

14. The valve according to claim 1, further comprising a visual indicator of an axial position of the valve head relative to the tube.

15. The timepiece comprising the valve according to claim 1.

16. The valve according to claim 1, further comprising a visual indicator of an axial position of a first or a second axial position of the valve head relative to the tube.

17. The valve according to claim 1, wherein the axial guiding elements include first and second guiding zones, respectively fully, or partly defined in an outer wall of a central connection element included in the cover of the valve head and in the inner wall of the fluid duct of the tube in an upper compartment of the fluid duct.

* * * * *